US010912385B2

(12) United States Patent
Kelley et al.

(10) Patent No.: US 10,912,385 B2
(45) Date of Patent: Feb. 9, 2021

(54) DYNAMIC ERGONOMIC CHAIR WITH ACTIVE, CONTINUOUS POSTURE ADJUSTMENT

(71) Applicant: INTERNATIONAL BUSINESS MACHINES CORPORATION, Armonk, NY (US)

(72) Inventors: John F. Kelley, Polk City, FL (US); Todd P. Seager, Orem, UT (US); Helaine M. Wasser, Cambridge, MA (US); Douglas S. Brown, Charlotte, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 335 days.

(21) Appl. No.: 15/976,625

(22) Filed: May 10, 2018

(65) Prior Publication Data

US 2019/0343283 A1 Nov. 14, 2019

(51) Int. Cl.

| | |
|---|---|
| ***A47C 1/032*** | (2006.01) |
| ***A47C 7/72*** | (2006.01) |
| ***A47C 31/12*** | (2006.01) |

(52) U.S. Cl.

CPC ..... *A47C 1/03211* (2013.01); *A47C 7/72* (2013.01); *A47C 31/126* (2013.01)

(58) Field of Classification Search

None

See application file for complete search history.

(56) References Cited

U.S. PATENT DOCUMENTS

| | | | | |
|---|---|---|---|---|
| 9,247,828 | B2 | 2/2016 | Cvek | |
| 10,614,694 | B1 * | 4/2020 | Zwier | G08B 25/08 |
| 2007/0106624 | A1 * | 5/2007 | Taylor | G16H 15/00 705/500 |
| 2011/0245979 | A1 | 10/2011 | Koch | |
| 2012/0226418 | A1 | 9/2012 | Veen et al. | |
| 2015/0120377 | A1 | 4/2015 | Marvit et al. | |

(Continued)

FOREIGN PATENT DOCUMENTS

WO 2009089647 A1 7/2009

OTHER PUBLICATIONS

International Search Report and Written Opinion for International Application No. PCT/IB2019/053767 dated Sep. 3, 2019.

(Continued)

*Primary Examiner* — Roy Y Yi

(74) *Attorney, Agent, or Firm* — Erik A. Huestis; Stephen J. Kenny; Foley Hoag, LLP

(57) ABSTRACT

A dynamic ergonomic chair with a sensor detects an adjustment to a position of a component of the chair and includes a user interface which updates a first user profile based on the detected adjustment to create a second user profile. The second user profile including a second workstation productivity measurement; the interface compares the first workstation productivity measurement of the first user profile with the second workstation productivity measurement of the second user profile, and/or medical outcomes, to determine an optimal user profile. The chair can dynamically adjust various components (e.g. armrest, recline angle, etc.) to enhance worker productivity.

20 Claims, 5 Drawing Sheets

(56) References Cited

U.S. PATENT DOCUMENTS

| | | | |
|---|---|---|---|
| 2015/0352990 | A1 | 12/2015 | Zouzal et al. |
| 2016/0183687 | A1 | 6/2016 | Hoyt et al. |
| 2016/0242548 | A1 | 8/2016 | Barnum et al. |
| 2016/0354027 | A1 | 12/2016 | Benson et al. |
| 2017/0325599 | A1 | 11/2017 | Bellam et al. |
| 2018/0029502 | A1 | 2/2018 | Georgiev et al. |

OTHER PUBLICATIONS

Huang et al., "Smart Chair for Monitoring of Sitting Behavior," DesTech Conference Proceedings, The International Conference on Design and Technology (2017)<https://knepublishing.com/index.php/KnE-Engineering/article/download/626/1929>.

* cited by examiner

DYNAMIC ERGONOMIC CHAIR WITH ACTIVE, CONTINUOUS POSTURE ADJUSTMENT

BACKGROUND

Embodiments of the present disclosure relate to ergonomic work environments. Particularly, the present disclosure relates to dynamic ergonomic equipment, e.g. chair, with active and continuous, intelligent, adjustments and control features to increase physiological comfort and optimize worker productivity.

BRIEF SUMMARY

According to embodiments of the present disclosure, apparatus and computer program products for active and continuous adjustment and control of workplace equipment to optimize a workers efficiency are provided. In an exemplary embodiment, the apparatus is configured as a chair with a motor to adjust at least one of: a height of the base portion, a recline angle of the back portion, and/or a height of the at least one armrest. A computer programmable memory is provided having a first user profile including a user's physical dimensions, e.g., body weight, height and health data; a recline angle of the back portion; a height of an armrest; and a first workstation productivity measurement. A sensor is also provided which detects an adjustment to a position of the base portion, back portion and/or armrest. A user interface, updates the first user profile based on the adjustment detected by the sensor to create a second user profile, the second user profile including a second workstation productivity measurement. The user interface also compares the first workstation productivity measurement of the first user profile with the second workstation productivity measurement of the second user profile to determine an optimal user profile for dynamic adjustments over time.

DETAILED DESCRIPTION

Figure 1:
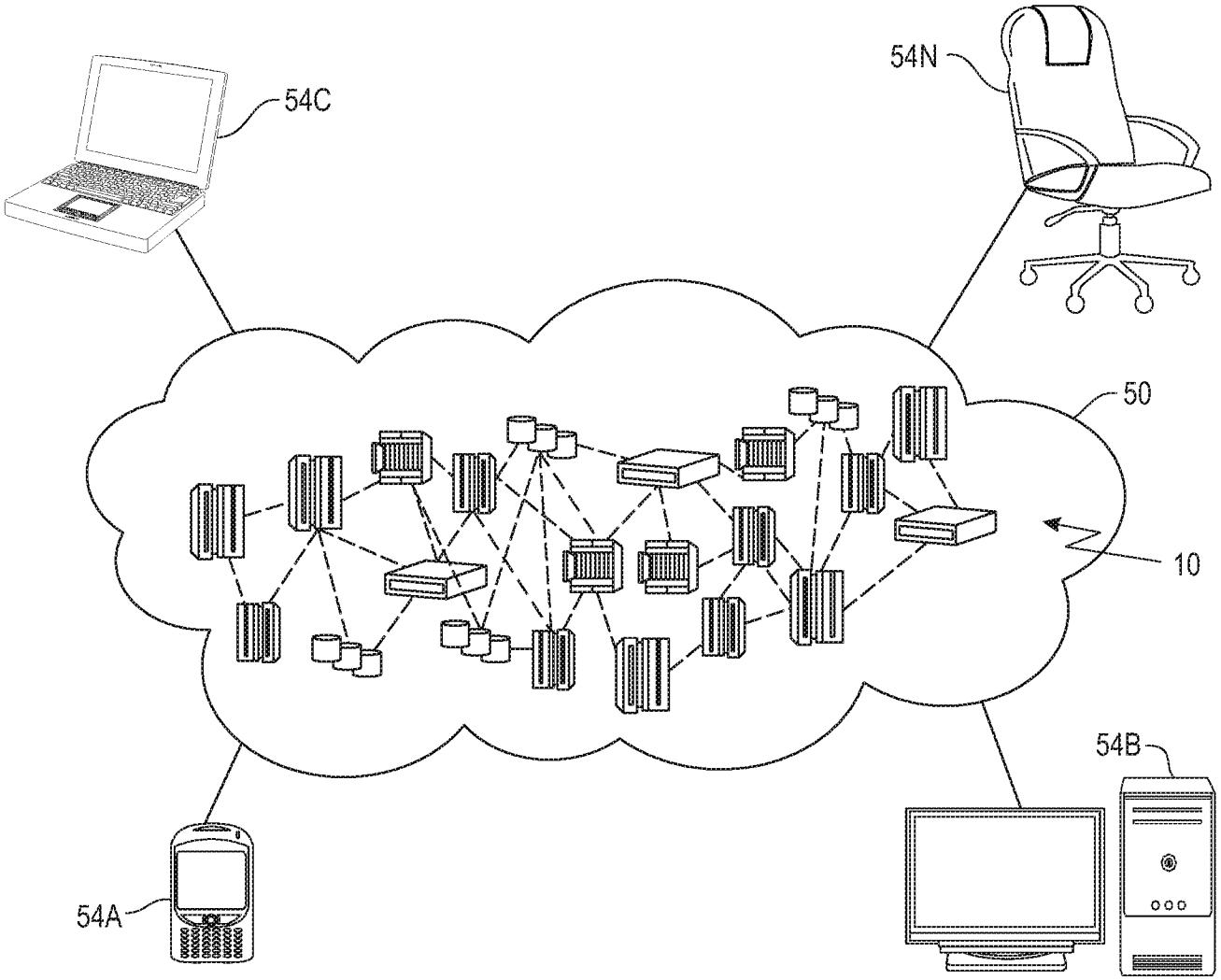
FIG. 1 depicts a cloud computing node according to an embodiment of the present disclosure.

It is understood in advance that although this disclosure includes a detailed description on cloud computing, implementation of the teachings recited herein are not limited to a cloud computing environment. Rather, embodiments of the present disclosure are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based email). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 2:
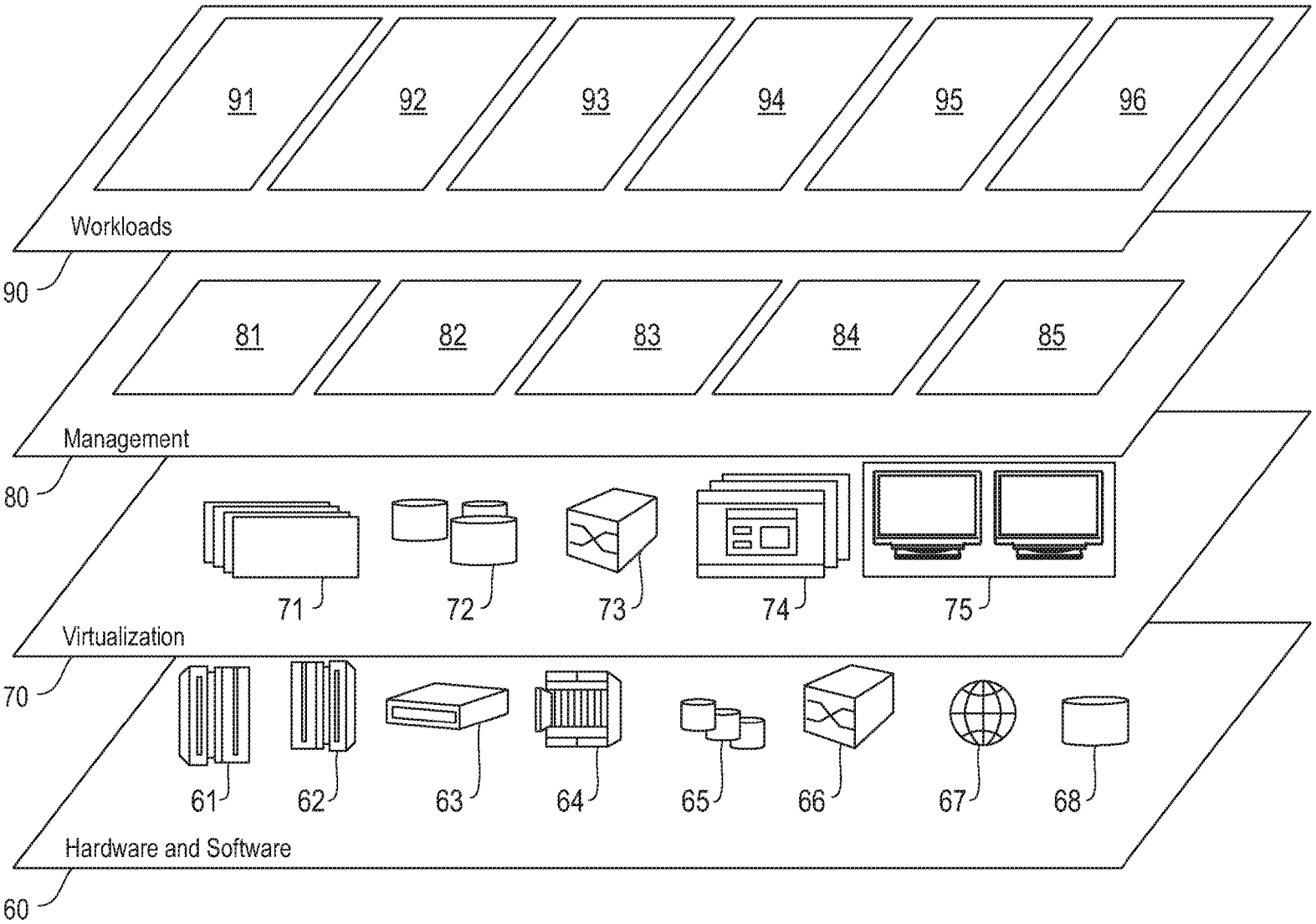
FIG. 2 depicts a cloud computing environment according to an embodiment of the present disclosure.
Figure 3:
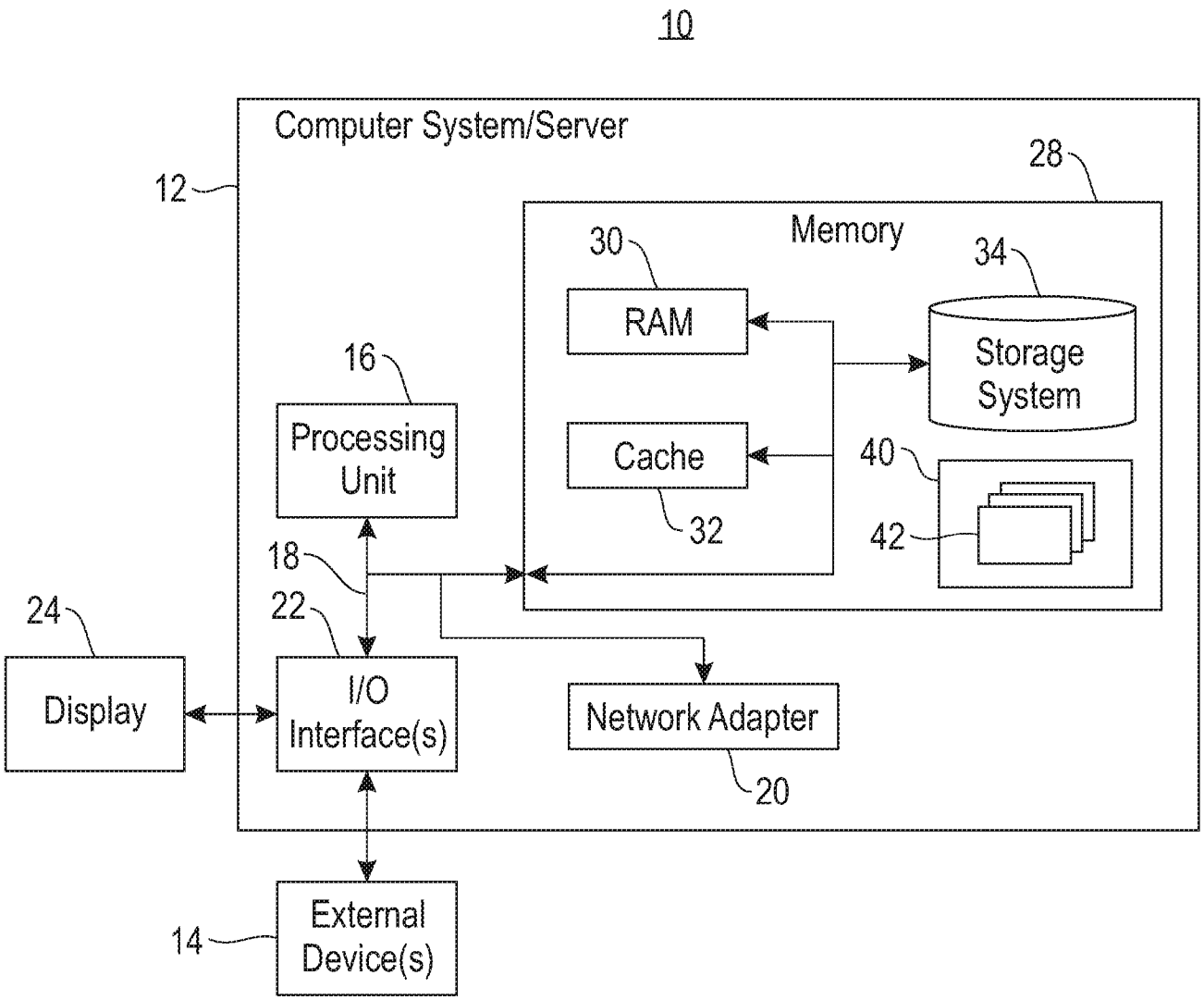
FIG. 3 depicts abstraction model layers according to an embodiment of the present disclosure.

Referring now to FIGS. 1-3, a schematic of an example of a cloud computing node is shown. Cloud computing node 10 is only one example of a suitable cloud computing node and is not intended to suggest any limitation as to the scope of use or functionality of embodiments described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIGS. 1-3, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, Peripheral Component Interconnect (PCI) bus, Peripheral Component Interconnect Express (PCIe), and Advanced Microcontroller Bus Architecture (AMBA).

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the disclosure.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the disclosure are not limited thereto. As depicted, the following layers and corresponding functions are provided:

Hardware and software layer 60 includes hardware and software components. Examples of hardware components include mainframes, in one example IBM® zSeries® systems; RISC (Reduced Instruction Set Computer) architecture based servers, in one example IBM pSeries® systems; IBM xSeries® systems; IBM BladeCenter® systems; storage devices; networks and networking components. Examples of software components include network application server software, in one example IBM WebSphere® application server software; and database software, in one example IBM DB2® database software. (IBM, zSeries, pSeries, xSeries, BladeCenter, WebSphere, and DB2 are trademarks of International Business Machines Corporation registered in many jurisdictions worldwide).

Virtualization layer 70 provides an abstraction layer from which the following examples of virtual entities may be provided: virtual servers; virtual storage; virtual networks, including virtual private networks; virtual applications and operating systems; and virtual clients.

In one example, management layer 80 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide prearrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation; software development and lifecycle management; virtual classroom education delivery; data analytics processing; transaction and processing.

The present disclosure allows for the efficacy of ergonomic adjustments to be measured, recorded and aggregated among users of varying physical attributes and/or work environments. The insight provided can be used to identify ways to improve employee productivity and health, as well as job satisfaction. Additionally, information about the efficacy of existing ergonomic adjustments may help employers determine whether to invest in similar equipment for the similarly situated employees as well as identify characteristics of employees that are likely to benefit from the ergonomic adjustments.

While the present disclosure is applicable to a variety of office equipment, for purpose of illustration and not limitation, the exemplary embodiments disclosed herein will primarily focus on a chair. Indeed, the terms "chair" and "apparatus" are used interchangeably herein, and it will be apparent to one of ordinary skill that the present disclosure can be implemented with various alternative apparatus other office equipment. The chair can include a base portion, a back portion, arm rests, which can be connected to at least one of the base or back portion for independent relative movement. The chair can also include a motor operatively connected to the base portion, back portion, and/or armrest to adjust at least one of: a height of the base portion, a base tilt angle, a recline angle of the back portion, and/or a height of an armrest, lumbar support thickness and height, etc. In some embodiments the apparatus can also include a footrest which can likewise be adjusted to a range of footrest height/knee angles, etc. It will be apparent to one of ordinary skill that various components of the chair, alone or in tandem with each other, can be repositioned to adjust a user's body part(s) as desired.

Additionally, the apparatus can include a variety of sensors for measuring and tracking position adjustments. A sensor can be any electrical, mechanical, electromechanical, electronic, or transducer-based device. A sensor is configured to detect a signal or an event. For example, a camera is a type of sensor that detects visually perceptible events, a microphone is a type of sensor that detects audibly perceptible events, a pressure sensor is a type of sensor that detects changes in applied pressures, a strain gauge is a type of sensor that detects changes in mechanical strain or stress, and an accelerometer is a type of sensor that detects force and accelerations.

Biometric sensors can also be used to detect, measure, or analyze various biometric features of a human. For example, one type of biometric sensor can detect the physical health of a person by analyzing the sweat of the person. Such a sensor can be mounted on a computer mouse and can detect from the palm sweat of the person operating the mouse whether the person is stressed, suffers from an ailment, or is taking certain medications.

In some embodiments, the sensors can be wearable (preferably wireless) to collect measurements such as: Heartrate, Blood pressure, Skin conductance/EMG, Glucose, Blood oxygen/perfusion, EEG (for detecting alpha brain wave patterns), as well as a Cortisol MIP sensor (e.g., in water bottle—to measure levels of stress hormone), Respiration sensor, and/or Doppler sensor for carotid (brain) blood flow. Another type of biometric sensor can detect the emotional state of a person by detecting eye-movements or the retina-image of the person. Such a sensor can be suitably mounted to observe a person's eyes and can detect whether the person is emotionally stressed, disturbed, restless, calm, or happy. These examples of the sensors are not intended to be limiting. From this disclosure, those of ordinary skill in the art will be able to conceive many other sensors and their operation in conjunction with an embodiment, and the same are contemplated within the scope of the illustrative embodiments.

Additionally, the apparatus can include a power supply (external or incorporated) which is operable on either AC or DC current. In some embodiments the apparatus includes removable an rechargeable battery packs which are advantageous in that they eliminate the need for cumbersome power cords which can restrict movement of the apparatus and present a tripping hazard. An onboard computer, with associated communications hardware (e.g., CPU, RAM, NVRAM, WIFI, Bluetooth, NFC, Cellular, etc.) is also incorporated into the apparatus for transmitting the measurements recorded by the various sensors.

The onboard operating system includes communication software, as well as a Chair Control Application for operating the various position adjustments. For example, the Chair Control Application can provide the following functions: Power on/off; Logging in/Connecting to off-board devices; transmitting/receiving to a cloud computing interface; selecting profiles of various user settings; provide a user interface to easily indicate measurement settings which are favorable (e.g. thumbs-up or thumbs-down for any given position). Furthermore, the Chair Control Application can periodically enter measurement setting which are subjective assessments of localized discomfort. Likewise, measurement settings which are updates of the current status of any related diagnosed medical conditions (e.g., carpal tunnel, bursitis, arthritis, deep vein thrombosis/DVT, varicose veins, restless leg syndrome, headaches, etc.) can also be entered. In some embodiments, an onboard display (e.g., LCD) and input controls (e.g. in a retractable arm-wrest) can be provided.

In some embodiments, an associated desktop application with measurements from a workstation performance tracking application and alternate or additional Chair Control Application can be included. Typically, such a desktop application would include a larger screen and thus provide for easier input. Additionally or alternatively, the Chair Control Application can be provided as a mobile application, and/or in conjunction with a wearable activity tracker which provides feedback and training profiles. The measurements and adjustments can be stored and/or transmitted via a cloud based computing service and undergo Big Data analytics. The system also provides for evolving user profiles which can be selected and downloaded to the apparatus, either periodically or on demand.

In operation, a user connects the chair to a workstation computer, which can be accomplished in a variety of ways, e.g. USB, Bluetooth, etc. The system monitors productivity measurements to assess the effects of adjustments to the chair's position, e.g. posture, on user productivity. For example, changes to the chair armrest height may impact mouse typing speed or mouse click targeting accuracy. A user interface can be included on a workstation, or mobile device, that allows the user to adjust various automatic posture adjustment profiles.

Additionally, the system can detect which tasks (e.g. reading, surfing, typing, etc.) a user is performing based on inferences from process monitoring. The system can then, without prompting or request from the user, select appropriate profile settings to adjust the chair to optimize efficiency for that particular task. The system can present the proposed profile setting change to the user for acceptance/confirmation, and/or automatically implement the profile setting change to adjust the chair accordingly. The preferred settings can be transmitted for cloud computing aggregation among a plurality of users to determine "ideal" chair settings for different tasks and/or working conditions. The data collected from the chair can be weighted and combined with additional/alternative activity tracking devices (e.g. wearable fitness trackers).

In some embodiments, a first sensor can detect a change in a user's position and require a second sensor to confirm or validate the detected change measured by the first sensor. For example a pressure transducer in the seat may detect the user leaning forward (e.g. to see the text on the display more clearly). A second sensor, e.g. camera on the monitor/display, can detect if the user is squinting in an attempt to read the display. The feedback from the second sensor confirms the measurement of the first sensor, and the system can automatically adjust the display (e.g. increase font size) to assist the user. Similarly, a first sensor can detect a change in position by a user (e.g. increased pressure on seatback) and activate a second sensor (e.g. camera to assess if user is deliberately reclined, or just slouching with poor posture) to confirm if the measurement of the first sensor requires warrants a change in position of the chair components. In some embodiments, the readings from a plurality of sensors are required to comport/confirm their respective readings in order to generate a position adjustment to the chair.

In accordance with an aspect of the disclosure, a user profile is created which provides a first set of positions for the various chair components (e.g. seat back angle, base height, etc.). Adjustments to these first or default positions are also captured within the user profile. Examples of the types of adjustments measured include: the change, or delta, in height/angle of a particular component(s); which part of the chair is being adjusted; how fast or slow the adjustment is performed; how often and when during a sitting the adjustment is performed. For example, browser clicking may be associated with a greater recline angle of the seat back, while typing may be associated with an upright posture and elevated armrest height.

The profiles are "living" specifications in that they are continually refined as data is collected and aggregated.

The algorithms contained in the user profiles can be refined by correlating the position control adjustments to the apparatus with the productivity measurements and/or medical outcomes, and then correlating the measurements with the desired effects. Examples of such a correlation include:

- An adjustment of 3 degrees of seat pan angle, flexing and then extending the hip joints, over a 20 minute period has a 12% chance of improving overall typing speed by 2% for office workers spending an average of 6 hours a day sitting at a workstation.
- An adjustment of footrest angle of 5 degrees, extending and then flexing the knee joint, when combined with the seat pan angle adjustment above, has a 22% chance of reducing new diagnosis of deep vein thrombosis by 15% for office workers spending an average of 6 hours a day sitting at a workstation.

In some embodiments, an initial profile can be pre-programmed into the Chair Control Application. For example, a preset "home" profile, which has a more relaxed/reclined configuration of the chair, and preset "office" profile, which has a more upright configuration with greater lumbar support, can be included. The preset profile(s) can be established using a full suite of feedback sensors and workstation productivity measurements from a seed set which is based on prior user data. For instance, an initial set of users can be used to connect to the cloud and use a variety of feedback sensors (e.g., the productivity monitoring application and a wearable activity tracker) to identify an aggregate preferred profile which can be set as a default profile. Alternatively, the system could also be provided with select rudimentary profiles (e.g. a predetermined subset of adjustments which vary randomly). With any preset profile, ongoing multivariate statistical analysis yields, and continuously refines, the productivity results as exemplified in correlations.

Figure 4:
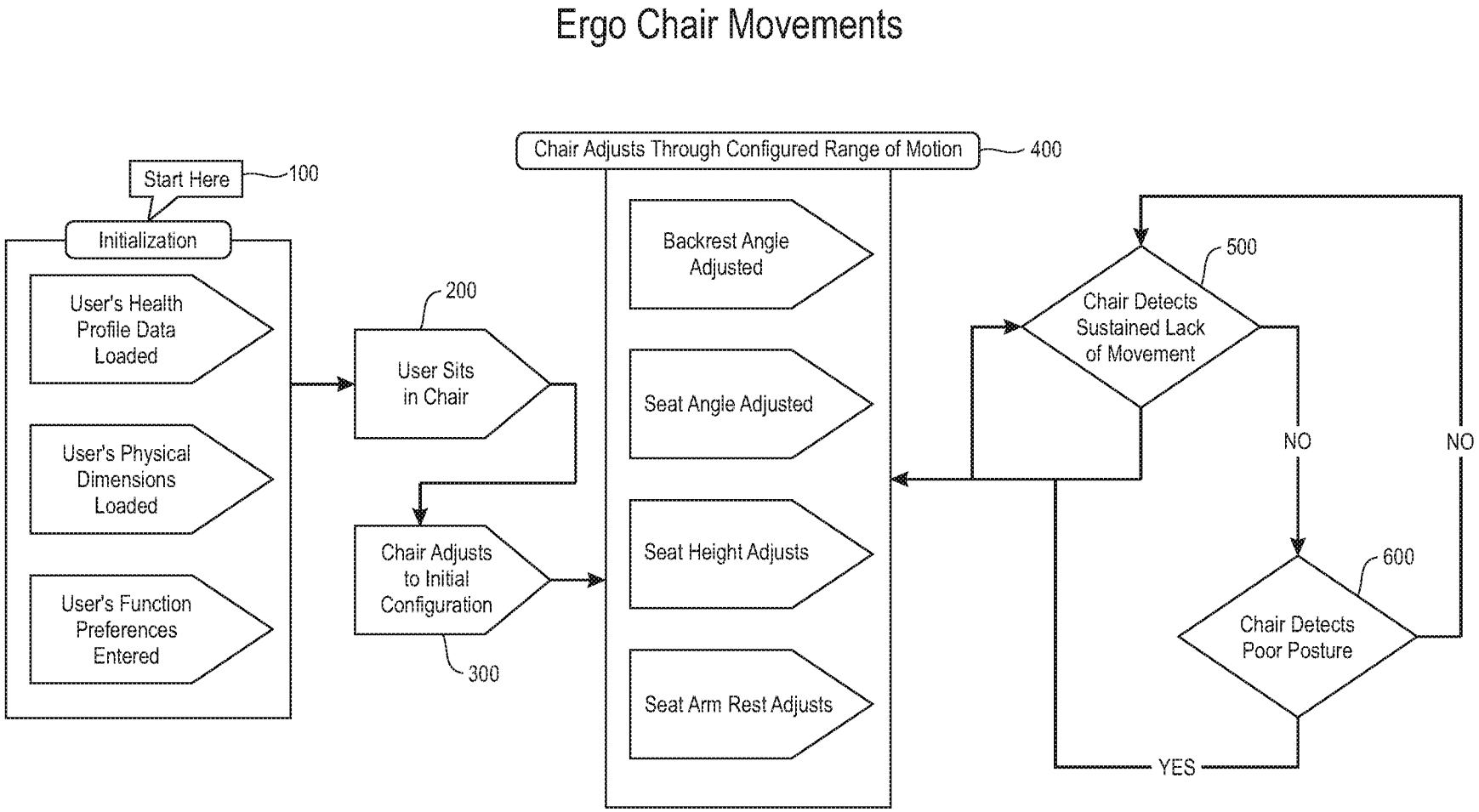
FIGS. 4-5 depict exemplary flow charts of the present disclosure.
Figure 5:
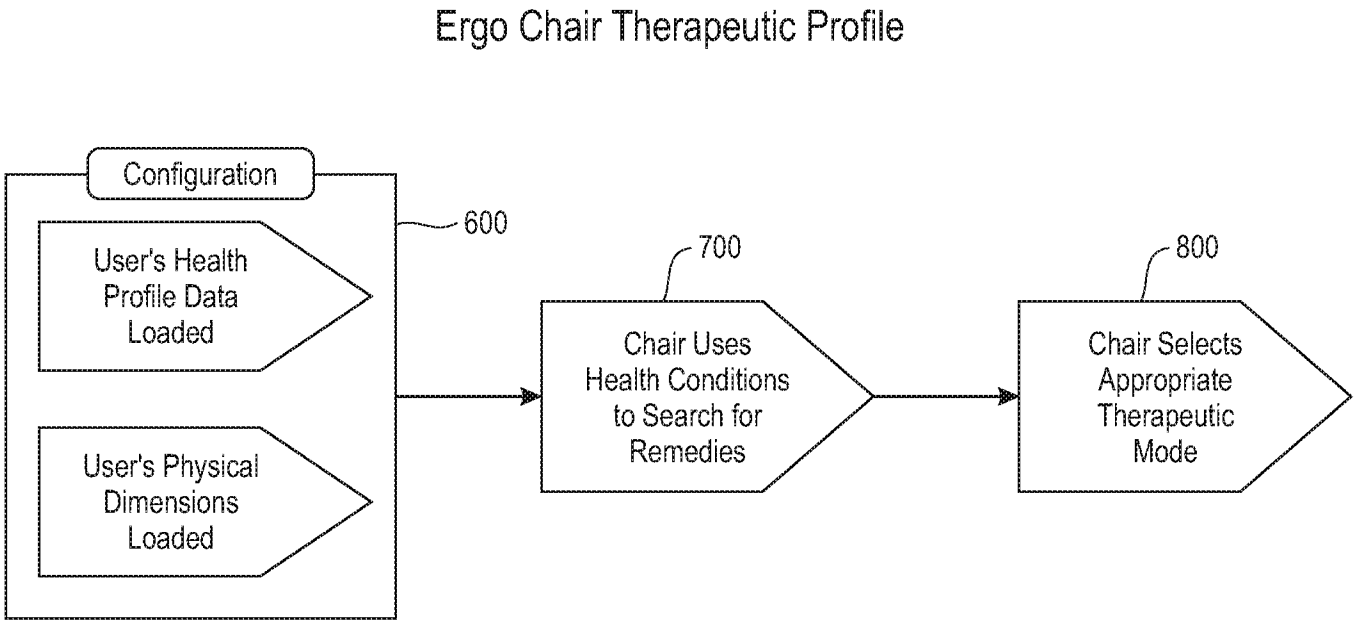

FIGS. 4-5 depict exemplary flow charts of the present disclosure. At 100 a user initiates the system by inputting health profile data, physical dimensions and any particular preferences. Next, the user sits in the chair 200, and the chair adjusts to an initial configuration 300 based on the user input. At 400 the chair adjusts one or more components through a predetermined range of motion. The chair monitors user movement 500, if movement is detected then the chair further adjusts the appropriate components 400. If no movement is detected the chair checks for improper or non-ideal positioning (e.g. poor posture) 600. When improper or non-ideal user positioning is detected, the chair adjusts the appropriate components to correct the user positioning 400. When there is no detection of improper or non-ideal positioning, the system loops back to restart the time period for detecting lack of user movement 500.

In accordance with another aspect of the disclosure, and as depicted in FIG. 5, a user can input health profile data and physical dimensions 600, from which the chair can search for optimal configurations and identify remedies for known health ailments 700. From the results of this search, the chair can select chair configurations and implement adjustments 800 to provide an appropriate therapeutic mode for the user.

In a first exemplary implementation of the present disclosure, the apparatus is provided with a select subset of standardized profiles. The user can select a profile from this subset to adjust the chair to the desired configuration. In such an implementation, the apparatus does not require communication with the cloud nor collection of data via the Chair Control Application. The user can select choice profiles from the pre-loaded subset, which adjust the apparatus accordingly, and rank (e.g. thumbs up, thumbs down) each profile based on preferred seating configurations.

In a second exemplary implementation of the present disclosure, the apparatus is connected, continuously or periodically, to the Chair Control Application. A user can browse profiles on the Chair Control Application and download select profiles to the apparatus. The user can decline to transmit productivity measurement data, e.g. to remain an anonymous user, if so desired. Instead, the user can access, on demand, a history of apparatus settings which can be locally stored on the apparatus. The Chair Control Application can provide recommended settings for the user based on analysis of the locally-stored historical data. Additionally, the user can periodically receive prompts when user profile updates are available from the remote/cloud server.

In a third exemplary implementation of the present disclosure, the apparatus is connected, continuously or periodically, to the Chair Control Application wherein the user allows for transmission data to the cloud for anonymous storage and analytics. The user can receive profile updates from the remote/cloud server and other cloud-based behavioral/postural/chair configuration tips, customized to each user.

In a fourth exemplary implementation of the present disclosure, the same functionality is provided as described in the third exemplary implementation above, and the user can install a productivity measuring program on a computer (i.e. separate from the chair/apparatus). This provides advanced correlations with productivity measures in the Big Data Cloud Analytics to refine profile algorithms, and more effective personal profiles tuned to actual user performance.

In a fifth exemplary implementation of the present disclosure, the same functionality is provided as described in the third exemplary implementation above, and the user provides input regarding medical condition(s), including changing diagnoses from medical professionals. This additional data allows for advanced correlations with medical outcomes in the Big Data Cloud Analytics to refine profile algorithms, and more effective personal profiles tuned to actual medical improvements.

In a sixth exemplary implementation of the present disclosure, the same functionality is provided as described in the third exemplary implementation above, and the user incorporates a wearable fitness/medical tracking device that "pairs" those devices to the Chair Control Application (or the Chair Control Application uses app-to-app API to connect to the apps associated with the devices). This implementation provides more effective cloud analytics, resulting in enhanced personalized profiles. In this implementation, the apparatus can supply sensor data (e.g. sitting/posture) to the fitness apps (e.g., "your target was to get out of your chair once per hour for 5 minutes—you reached 90% of your goal for last week.")

The present disclosure may be embodied as a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An apparatus for supporting a user in a seated position comprising:

a base portion;

a back portion;

at least one armrest, the arm rest connected to at least one of the base or back portion;

a motor, the motor operatively connected to at least one of the base portion, back portion, or armrest to adjust a position of the at least one of:

a height of the base portion, a recline angle of the back portion, a height of the at least one armrest;

a database comprising a first user profile, the first user profile including:

user physical dimensions including at least one of body weight, height and health data, a recline angle of the back portion, a height of the at least one base portion, and a first workstation productivity measurement;

at least one sensor configured to detect an adjustment to a position of at least one of the base portion, back portion and armrest;

a computing node comprising a computer readable storage medium having program instructions embodied therewith, the program instructions executable by a processor of the computing node to cause the processor to perform a method comprising:

receiving the adjustment from the at least one sensor;

determining a second workstation productivity measurement based on the adjustment;

when the second workstation productivity measurement is higher than the first workstation productivity measurement, updating the first user profile based on the adjustment to create a second user profile; and applying the second user profile to the motor.

2. The apparatus of claim 1, wherein the productivity measurement includes at least one of typing speed, typing accuracy, mouse movement, or mouse-click target accuracy.

3. The apparatus of claim 1, wherein the user interface determines a task performed by a user.

4. The apparatus of claim 3, wherein the user interface automatically selects an alternate profile based on the task detected, the alternate profile including an adjustment to at least one of the base portion, back portion, or armrest.

5. The apparatus of claim 1, wherein the user interface includes a preset profile(s).

6. The apparatus of claim 5, wherein the preset profile(s) is based on prior user data.

7. The apparatus of claim 1, wherein the user can rank a plurality of profiles.

8. The apparatus of claim 1, wherein the at least one sensor includes at least one of a transducer, accelerometer, optical, or biometric sensor.

9. The apparatus of claim 1, wherein at least one sensor is disposed on the apparatus for supporting a user.

10. The apparatus of claim 1, wherein at least one sensor is a wearable sensor configured to measure physiological data.

11. The apparatus of claim 1, further comprising first and second sensors, wherein the second sensor confirms the measurement of the first sensor.

12. The apparatus of claim 1, wherein user profiles are refined by correlating adjustments to at least one of the base portion, back portion, or armrest with the work productivity measurements.

13. A computer program product comprising a computer readable storage medium having program instructions embodied therewith for dynamic adjustment of an ergonomic workstation, the program instructions executable by a processor of the computing node to cause the processor to perform a method comprising:

receiving a first user profile, the first user profile including:

user physical dimensions including at least one of body weight, height and health data, a recline angle of the back portion, a height of the at least one base portion, and a first workstation productivity measurement;

determining an activity being performed in a workplace by a user;

determining a first workstation productivity measurement;

receiving, from at least one sensor, an adjustment to a portion of the ergonomic equipment;

determining a second workstation productivity measurement based on the adjustment;

when the second workstation productivity measurement is higher than the first workstation productivity measurement, updating the first user profile based on the adjustment to create a second user profile;

applying the second user profile to a motor of the ergonomic workstation.

14. The computer usable program of claim 13, wherein updating the first user profile operates independent of a participation of the user.

15. The computer usable program of claim 13, wherein updating the first user profile requires participation by the user.

16. The computer usable program of claim 13, wherein productivity measurement includes at least one of typing speed, typing accuracy, mouse movement, or mouse-click target accuracy.

17. The computer usable program of claim 13, wherein the first user profile is a preset profile.

18. The computer usable program of claim 17, wherein the preset profile is based on prior user data.

19. The computer usable program of claim 13, wherein the user can rank a plurality of profiles.

20. A method of dynamically adjusting an ergonomic workstation apparatus comprising:

providing a device for engagement by a user;

storing, in a database, a first user profile, the first user profile including:

user physiological data, a first position of the device, and a first workstation productivity measurement;

determining an activity being performed in a workplace by a user;

determining a first workstation productivity measurement;

determining, from a sensor, an adjustment to a portion of the ergonomic equipment;

determining a second workstation productivity measurement based on the adjustment;

when the second workstation productivity measurement is higher than the first workstation productivity measurement, updating the first user profile based on the adjustment to create a second user profile;

applying the second user profile to a motor of the ergonomic workstation, wherein the second profile adjusts the workstation to a second position, the second position associated with the second workstation productivity measurement.

* * * * *